United States Patent [19]

Trevaskis

[11] Patent Number: 5,048,699

[45] Date of Patent: Sep. 17, 1991

[54] DISPLAY STAND AND/OR FRAME

[75] Inventor: Thomas R. Trevaskis, Toorak, Australia

[73] Assignee: Megaspace Pty. Ltd., Richmond, Australia

[21] Appl. No.: 410,883

[22] Filed: Sep. 22, 1989

[51] Int. Cl.[5] ..... A47F 7/00

[52] U.S. Cl. ..... 211/59.2; 211/128

[58] Field of Search ..... 211/59.2, 128, 81, 55, 211/150, 47; 312/42

[56] References Cited

U.S. PATENT DOCUMENTS

| | | | |
|---|---|---|---|
| 3,019,907 | 2/1962 | Belejack | 211/59.2 |
| 3,570,679 | 3/1971 | Edson | 211/150 X |
| 4,387,810 | 6/1983 | Crosslen | 211/59.2 |
| 4,531,646 | 7/1985 | Howard | 211/59.2 X |

FOREIGN PATENT DOCUMENTS

| | | |
|---|---|---|
| 497474 | 10/1978 | Australia . |
| 513577 | 4/1980 | Australia . |
| 64540/80 | 6/1981 | Australia . |
| 563049 | 11/1984 | Australia . |

*Primary Examiner*—Alvin C. Chin-Shue
*Assistant Examiner*—Sarah A. Lechok
*Attorney, Agent, or Firm*—Fleit, Jacobson, Cohn, Price, Holman & Stern

[57] ABSTRACT

A display/dispenser cabinet for selling cigarettes and other boxed merchandize. The cabinet has vertically spaced trays each capable of limited turning movement about its own rear horizontal axis fixed with respect to the cabinet. In a lower or use position the plane of the tray is sufficiently declined from the hozizonatal to cause a front-to-rear stack of boxes to slip forwards when a purchaser removes a box from the front of the stack. The tray can be raised to an upper position for re-stocking or for raising the next lower tray. Pairs of front supports are such that each pair supports one tray in the lower position and the next lower tray in the upper position. The raising of any tray requires the prior raising of a tray next above.

3 Claims, 3 Drawing Sheets

DISPLAY STAND AND/OR FRAME

This invention relates to a device or container for displaying items e.g. merchandize such as cigarette packaged in rectangular boxes and other objects of generally parallelepipedal form required to be held ready for convenient dispensing from a suitably compact and visible stack, row or other arrangement.

A known kind of stand consists essentially of an inclined tray or chute adapted to receive and support a stack of e.g. cigarette-boxes, a foremost of which is held by a flange or like abutment at the lower front end of the chute. The lastmentioned is at such an angle that as the foremost box is removed by being lifted from the front end of the chute, the stack of remaining boxes slips down the chute under gravity, thereby advancing by one place, and the next box is ready for removal or dispensing in like manner to the first.

A parallel arrangement of such chutes can readily be provided by dividing a tray into channels by parallel, equispaced partitions, and a display stand may comprise a bank of such trays supported parallelwise, one above the other, in a frame or other suitable structure.

Considerations of space and compactness, combined with an angle of inclination necessary for reasonably ensuring that the articles will readily slip forward when required, often mean that the rear end portions of all chutes (except those of the topmost tray) are relatively inaccessible. This can be inconvenient for refilling and cleaning.

Australian specification 64540/80 (L. Weber) discloses a merchandizing display stand comprising shelf plates or trays arrangeable one above the other between two parallel vertical side-walls defining positions for front and rear supporting of the trays.

At its rear each tray has pivot means defining a pivoting axis fixed with respect to the tray, and is supported front and rear between the side walls for tilting movement about said axis between positions of different inclinations to the horizontal.

However such pivoted systems can be unduly complex to make and operate. We have found it advantageous for the pivoting axis to be fixed with respect to the cabinet or housing rather than to the trays.

It is therefore an object of the invention is to provide a simple, versatile, modular and readily accessible and replenishable shop display stand for boxes of confectionery, cigarettes and other merchandize.

This and other objects and advantages will become apparent hereinafter.

Accordingly the present invention provides a dispenser device for packages of cigarettes or other merchandize required to be held ready for convenient removal from the front end of a compact and visible stack of such packages, said device including an open-fronted cabinet adapted to house a plurality of vertically-spaced trays each tiltable about a rear axis between a first, lower or "use" position; and a second, raised position wherein access is facilitated for re-stocking the next lower tray or for raising the next lower tray to its second position, rear supports for the tray including vertically-spaced horizontal axle means fixed with respect to the cabinet providing said rear axis for each tray, there being further provided for each tray at least one front support or one pair of opposed front supports fixed with respect to the cabinet adapted to support the front of the relevant tray in the first position or to support the front of the next lower tray in the second position, the raising of any tray necessitating the prior raising of any or all of the trays immediately above.

But in order that the invention may be better understood reference will now be made to the accompanying drawings which are to be considered as part of this specification and read herewith. In the drawings.

Figure 1:
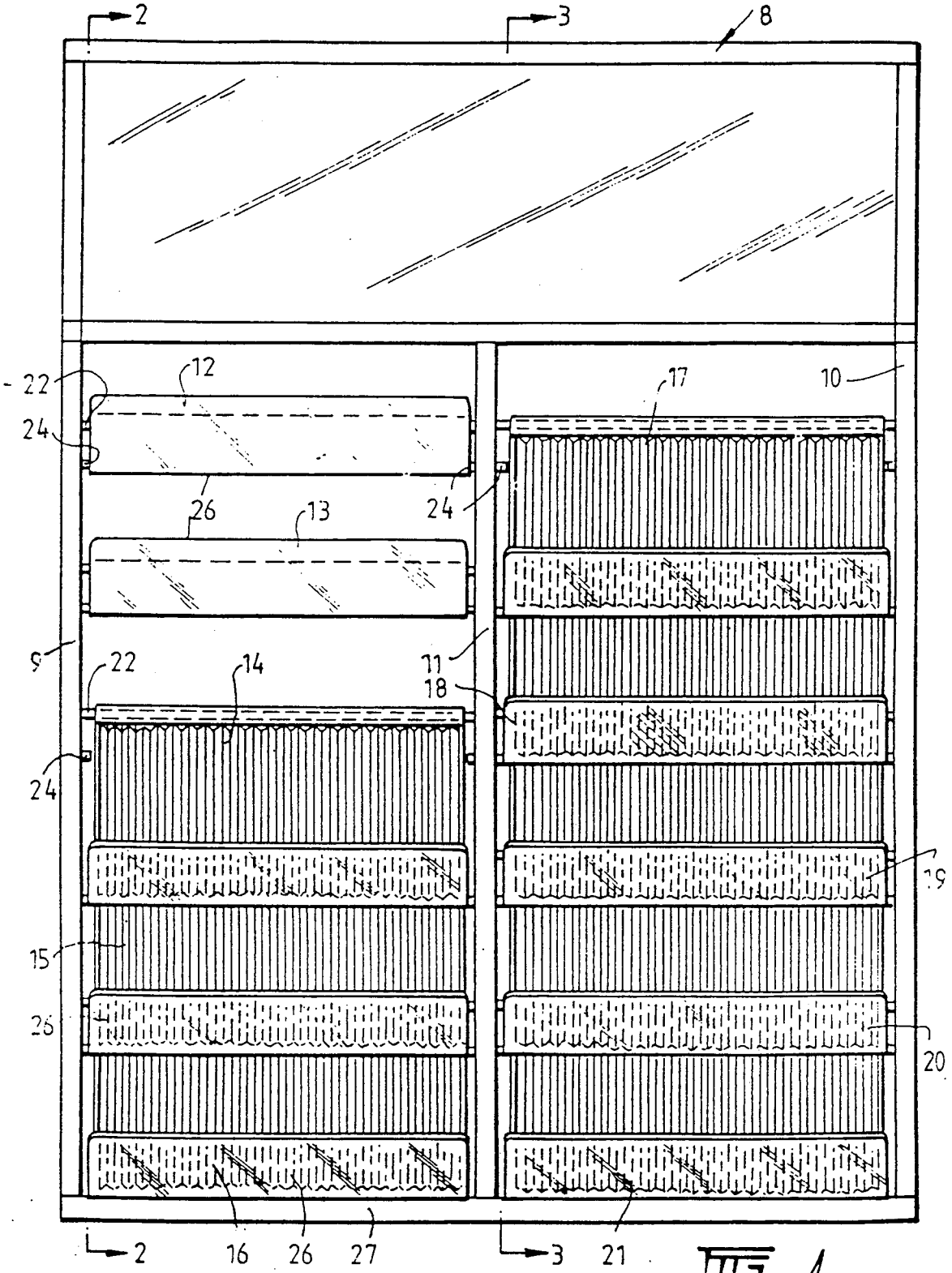
FIG. 1 is a front elevation of a practical embodiment of display device in accordance with the invention, having two sets of trays.

Referring to the drawings in more detail the display device includes a open-fronted cabinet 8 having side walls 9, 10 and a central support 11 for two sets of vertically spaced trays, the first set 12 to 16 inclusive being supported between 9 and 11 and the second set 17 to 21 inclusive between 10 and 11. Fixed or fixable to the rear of cabinet 8 is a series of vertically-spaced horizontal axles 22 providing a rear support for each tray. For this purpose the rear of each tray has or is formed as a generally downturned flange 23 or clips whereby the tray is adapted loosely to hook over the relevant axle 22.

Figure 6:
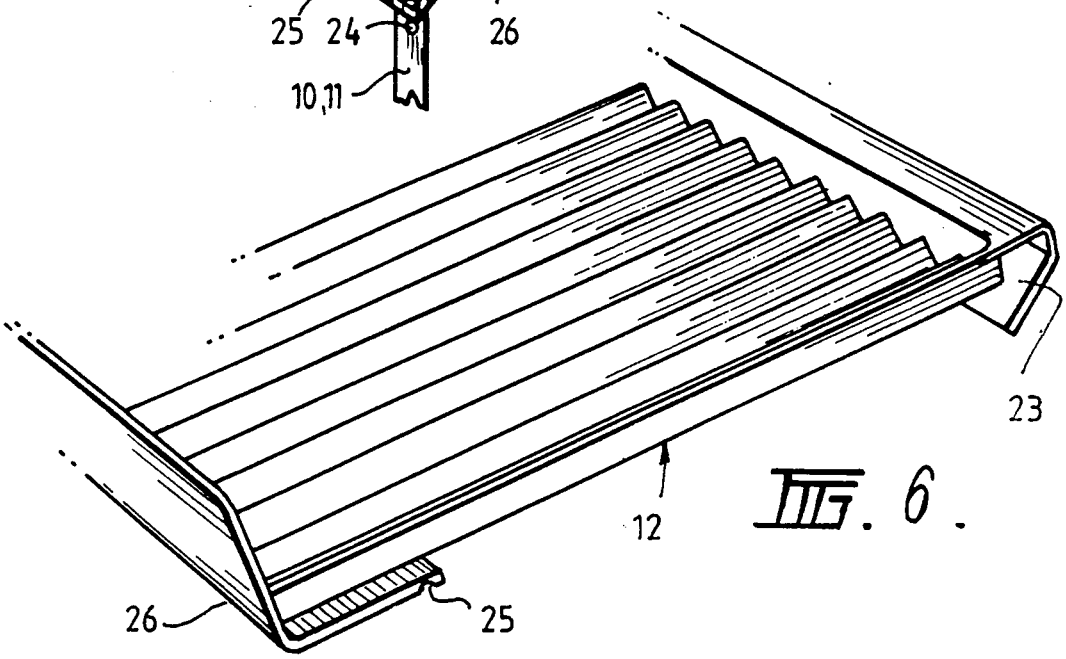
FIG. 6 is a perspective view of portion of a tray.
Figure 7:
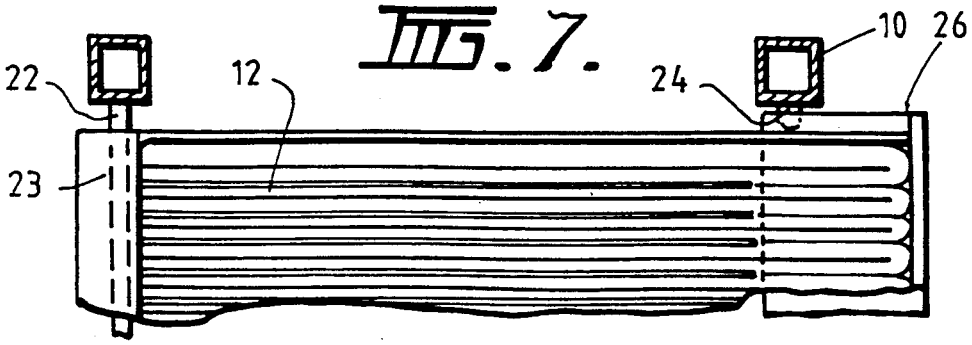
FIG. 7 is a top plan of the portion of the tray shown in FIG. 6, from the aspect shown by lines 7—7 in FIG. 2, indicating its relationship with the supports (FIG. 5).

Front supports for the trays are provided by studs 24 projecting inwardly from the side walls 9, 10 and support 11. In the second position the studs are receivable in recesses 25 (FIG. 6) formed in a lower, laterally projecting part of fascia 26. Advantageously such supports are provided for both sides of each tray. The system enables the trays to be supported either in a first, lower or "use" position, or a second, raised position. In the illustrated embodiment, trays 14 to 21 inclusive are in the first position, and 12 and 13 are in the second position. It is seen that the first position studs for trays 12 to 15 and 17 to 26 are the second position studs for trays 13 to 16 and 18 to 21 respectively. First position studs are not provided for the lowest trays 16, 21 which simply rest upon member 27 forming part of the cabinet structure.

Figure 2:
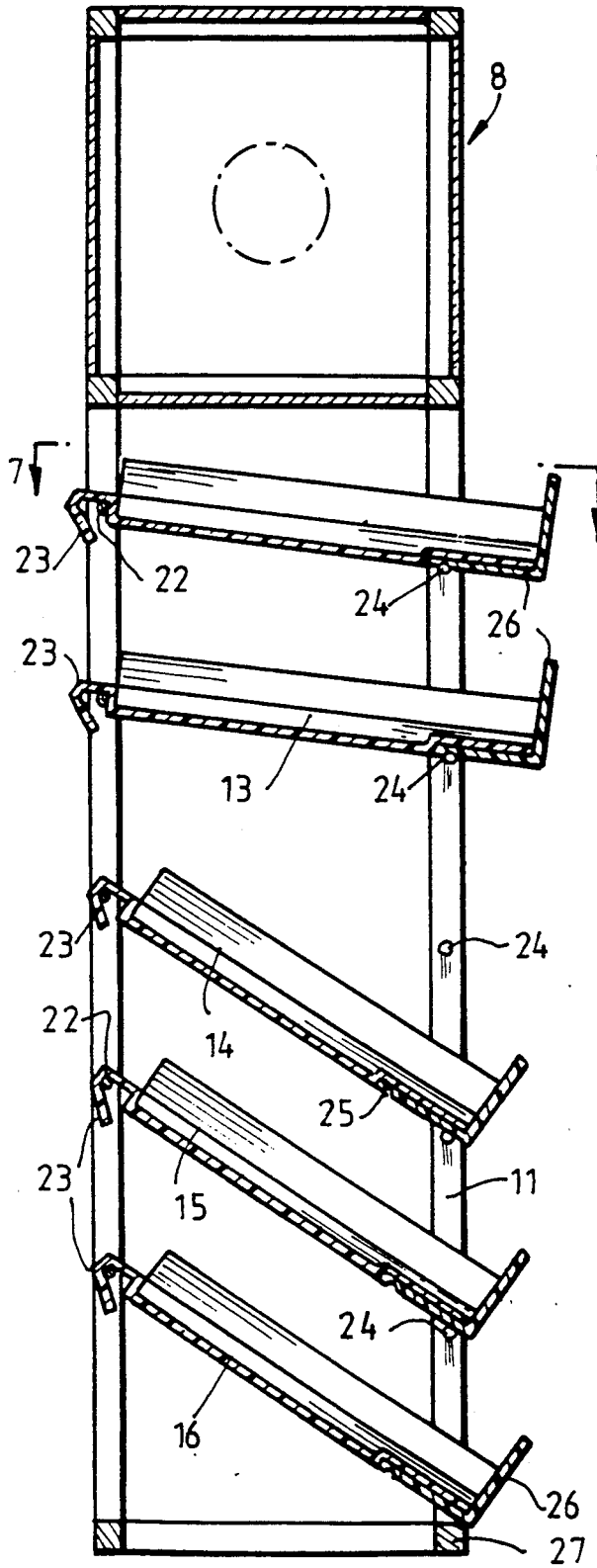
FIG. 2 is a section across line 2—2 in FIG. 1.
Figure 3:
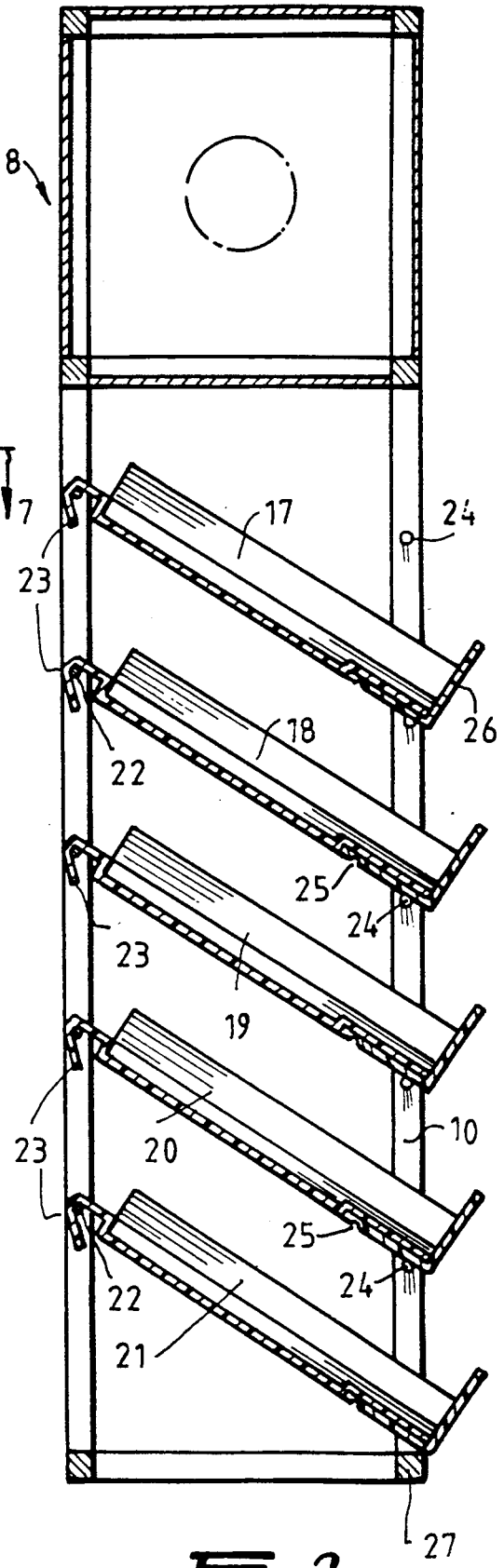
FIG. 3 is a section across line 3—3 of FIG. 1.
Figure 5:
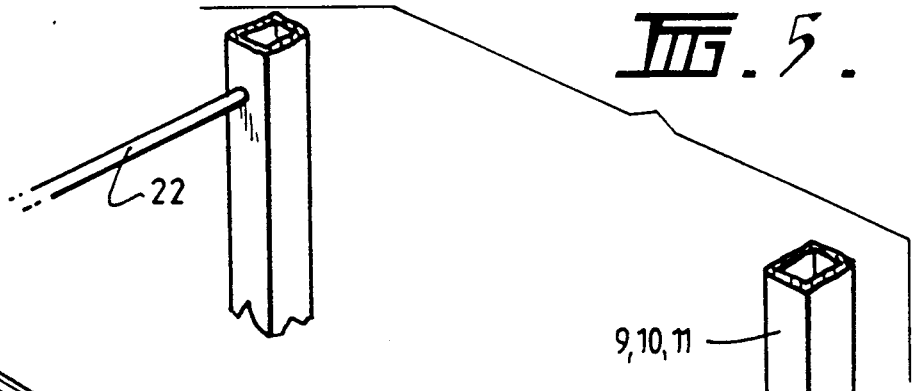
FIG. 5 shows portions of front and rear posts of the cabinet and front and rear supports for a tray.
Figure 4:
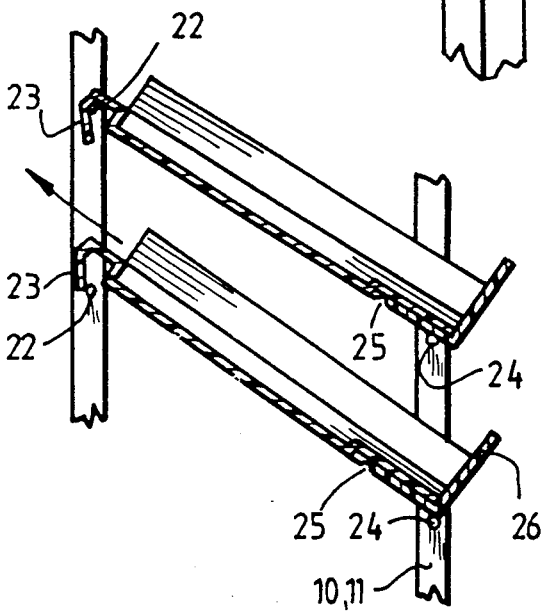
FIG. 4 shows two adjacent trays in the first ("use") position, and also showing how the lower can be removed if required.

In use, the trays are fitted with a stack of cigarette or like packages (not shown) and the angle of the trays in the first position permits easy slippage of the stack as articles are removed from the front of the trays. All trays except the topmost may be re-stocked or "topped up" from the front by raising the next higher tray to its second position. It is seen that this will require all trays above it to be raised before access is afforded to the tray to be re-stocked. Therefore in FIG. 2, for example, trays ;2 to 14 inclusive are in position for re-stocking 14, which has required firstly that 12 and secondly that 13 were raised to the second positions, in which they are shown.

The configuration of flanges 23 permits a degree of "play" or relative translational displacement between the tray and axle 22. To move a tray from the second to the first position, it is lifted so that studs 24 are clear of recesses 25, and then pulled forward slightly so that the projecting part of fascia 26 is clear of the studs, and the tray can then be lowered until it contacts the next lower studs.

The trays may be vacuum-formed board with clip-on fascias or other devices, as required, for engaging the supports. A clear acrylic fascia or abutment stop flange may be glued to the front edge, both to hold the foremost box when the tray is in the first (normal) position, and to enable the boxes themselves to be readily visible.

The association between the axle means and the cabinet may provide advantageous strengthening for the latter.

The framework may itself be a generally rectangular gantry-like structure comprising four corner posts and front, back and side rails at top and bottom. The frame may be assembled ad hoc by the user from a kit of parts including rods and connectors e.g. according to our registered designs 90331, 90332, 98620 and/or 99425. A central front post may have studs, as aforementioned, on each side.

The top and sides of the framed space may be closed by panels of suitable material. Looking from the front the "interior" of the space may be divided horizontally by members defining an upper part, the back of which may be closed, containing a suitable light fitting, and the remainder of the space divided vertically into left and right portions, one or both of which may contain trays.

For purposes of this specification expressions such as "inclined", "above", "vertical", "horizontal", "upper", "higher", "lower", "foremost", "front", "rear", and "topmost" refer to the invention in use and are not to be read as necessarily limiting.

I claim:

1. A display/dispenser device for packages of cigarettes or other merchandize required to be held ready for convenient removal from the front end of a compact and visible stack of said packages, said device including an open-fronted cabinet adapted to house a plurality of vertically-spaced trays having a laterally extending flange on the front portion thereof each tiltable about a rear axis between a first, lower or "use" position; and a second, raised position wherein access is facilitated for re-stocking the next lower tray or for raising the next lower tray to its second position, rear supports for the tray including vertically-spaced horizontal axle means fixed to the cabinet the axle means providing said rear axis for each tray, there being further provided for each tray a front support fixed to the cabinet, said front support being positioned to support the front of the relevant tray by supporting said flange in the first position and also to support the front of the next lower tray in the second position by supporting said flange the raising of any tray necessitating the prior raising of any or all of the trays immediately above wherein the rear supports are shaped to allow lengthwise movement of the tray.

2. A device as claimed in claim 1 wherein the rear supports include a flange or clip on the tray to hook over the relevant axle means and the axle means for each tray is in the form of a rod.

3. A device as claimed in claim 2, wherein the flange or clip is shaped to allow lengthwise movement of the tray enabling the lateral flange to clear the relevant front support when moving between the second and first positions.

* * * * *